US006892631B2

(12) United States Patent
Scheidler et al.

(10) Patent No.: US 6,892,631 B2
(45) Date of Patent: May 17, 2005

(54) PROCESS FOR OPERATING A CALENDER

(75) Inventors: Eva Scheidler, Nattheim (DE); Robert Wolf, Herbrechtingen (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/192,554

(22) Filed: Jul. 11, 2002

(65) Prior Publication Data

US 2003/0024414 A1 Feb. 6, 2003

(30) Foreign Application Priority Data

Jul. 12, 2001 (DE) ..... 101 33 889

(51) Int. Cl.[7] ..... B30B 11/22

(52) U.S. Cl. ..... 100/35; 100/41; 100/158 R; 100/159; 100/161; 100/169

(58) Field of Search ..... 100/35, 41, 47, 100/155 R, 157, 158 R, 162 R, 162 B, 163 R, 168, 169, 176; 72/10.2, 10.3, 10.4, 172

(56) References Cited

U.S. PATENT DOCUMENTS

| | | | | | |
|---|---|---|---|---|---|
| 3,044,392 | A | | 7/1962 | Minarik et al. | |
| 3,240,148 | A | * | 3/1966 | Varga | 100/158 R |
| 4,117,054 | A | * | 9/1978 | Salo | 264/40.1 |
| 4,348,952 | A | * | 9/1982 | Gooch | 100/158 R |
| 4,516,491 | A | * | 5/1985 | Winter | 100/158 R |
| 5,501,145 | A | * | 3/1996 | Fromm | 100/158 R |
| 5,961,899 | A | | 10/1999 | Rossetti et al. | |
| 6,199,476 | B1 | * | 3/2001 | Kayser | 100/35 |
| 2002/0060021 | A1 | | 5/2002 | Kayser et al. | |

FOREIGN PATENT DOCUMENTS

| | | |
|---|---|---|
| DE | 19601293 | 7/1997 |
| DE | 19815339 | 10/1999 |
| EP | 949378 | 10/1999 |
| EP | 1127977 | 8/2001 |
| WO | 9925921 | 5/1999 |

OTHER PUBLICATIONS

Document "Calender Vibration—A Simulation Study and a Cure," Tappi Journal, vol. 52, No. 7, Jul. 1969, pp. 1356 through 1361.

Document "Calender barring on paper machines—practical conclusions and recommendations," Tappi Journal, vol. 58, No. 8, Aug. 1975, pp. 147 through 151.

Hermanski, "Barringbildung am Glättkalander einer Papiermaschinen,"Das Papier, No. 9, pp. 581–590, XP001118222 (1995).

Parker et al., "Analysis and Control of Calender Barring", *Paper and Pulp Canada*, vol. 76, No. 10, pp. 89–91 (Oct. 1975).

Epton et al., "Glätterwerk–Barring und Naβpressenvibration", *Wochenblatt für Papierfabrikation* 17, pp. 616–622 (1981).

Parker, "Investigation of Vibrations and Disturbances", *Paper and Pulp Canada*, vol. 80, No. 7, pp. 39–43 (Jul. 1979).

Huser et al., "Selbsterregte Schwingungen in Mehrwalzen–Glätterwerk", *Escher Wyss Mitteilungen ½*, pp. 200–207 (1980).

* cited by examiner

*Primary Examiner*—Allen Ostrager
*Assistant Examiner*—Shelley Self
(74) *Attorney, Agent, or Firm*—Greenblum & Bernstein, P.L.C.

(57) ABSTRACT

Process for operating and calender with a roll stack having a plurality of rolls, including two end rolls arranged to form a press plane and middle rolls arranged between the end rolls. The plurality of rolls includes at least one elastic roll. The process includes displacing at least one roll relative to the press plane at periodic intervals.

28 Claims, 3 Drawing Sheets

PROCESS FOR OPERATING A CALENDER

CROSS-REFERENCE TO RELATED APPLICATIONS

The present application claims priority under 35 U.S.C. §119 of German Patent Application No. 101 33 889.9, filed Jul. 12, 2001, the disclosure of which is expressly incorporated by reference herein in its entirety.

BACKGROUND OF THE INVENTION

1. Field of the Invention

The invention relates to a process for operating and a calender with a roll stack that features two end rolls in a press plane with several middle rolls located between the end rolls. At least one of the rolls includes an elastic surface.

2. Discussion of Background Information

The invention is described below on the basis of a calender that is used for glazing paper or cardboard webs. However, it can also be used in the same way with other material webs with which similar problems occur.

When glazing a paper web, the paper web is guided through the calender and into nips that are formed between a hard and a soft roll, i.e., a roll with an elastic surface, and is acted upon by increased pressure and, if necessary, also by increased temperature. In the case of calenders of more recent construction types, e.g., the "Janus calenders," rolls are used that are covered with a plastic coating. It can now be observed that in many cases crosswise stripes occur on the paper web after a certain working time. As soon as these crosswise stripes become visible, the paper web becomes useless and forms broke. The reasons for this so-called barring formation have not yet been conclusively established. However, it is assumed that they are the effects of a vibration phenomenon. However, vibrations are virtually unavoidable in a calender.

Barring phenomena per se have also occurred earlier, namely with calender stacks, i.e., calenders that were equipped exclusively with hard rolls. However, in this case, the reasons for the barring formation are assumed to lie in the paper web, i.e., the periodic occurrence of changes in thickness, which were caused, e.g., by a slightly pulsating headbox.

In the case of calender stacks, it has been tried to prevent such a barring formation either by arranging a guide roll at alternating distances from the roll stack, or by laterally displacing one or more rolls from the press plane.

However, in the case of barring formation on soft rolls, in particular plastic rolls, this is a different phenomenon. Here it can be observed that the elastic surface layer changes by itself within a relatively short time. When a barring phenomenon occurs, the roll that exhibits the barring formation must be removed and reground or finished. The service life of such a roll is therefore limited.

In the barring formation the soft roll is changed on its elastic surface. It has not yet been conclusively determined what this change actually entails. The following possibilities are currently assumed: the roll develops a waviness on the surface, i.e., a hill and valley structure, the roll becomes polygonal, or the roll develops alternating zones of varying surface quality in the circumferential direction, e.g., varying roughness. Regardless of the concrete type of change, after the barring formation periodic stripes appear on the circumference of the roll running in the axial direction. Corresponding stripes then appear on the paper web, whereby the paper web is to be considered as broke by the time the stripes become visible at the latest.

SUMMARY OF THE INVENTION

The present invention increases the service life of such a roll.

According to the invention, with a process of the type mentioned at the outset includes that at least one roll is displaced relative to (i.e., substantially perpendicular to) the press plane at periodic intervals.

It is therefore ensured that a roll is displaced relative to the press plane. A roll stack formed of several rolls has a plurality of natural frequencies. It is noted that this does not refer to the natural frequencies of the individual rolls, such as, e.g., natural frequencies in bending, but to the natural shapes of vibrations that result from the vibrating roll masses on the spring and damping systems of the interposed plastic coatings of the "soft" rolls. A running calender produces exciter forces, the frequencies of which are composed of the multiple of the roll rotational speeds. These exciter forces can be due to inhomogeneities, anisotropies or geometry errors (out of roundness). Fluctuations in paper thickness of the paper web running through the calender can also stimulate the roll stack. A paper web running into the calender is still very rough before the glazing process. In addition, a paper web is never free from basis weight or thickness fluctuations. If these fluctuations are analyzed with the aid of a FFT analysis of their frequencies, as a rule a wide-band noise is determined, which contains all the frequencies. If one of these exciter frequencies meets a natural frequency, the vibration system of the calender responds with enlarged vibration amplitudes. These resonance points cannot be constructively avoided because of the large number of possible exciters and the large number of possible natural shapes of vibrations. As a rule, the vibration system is also so greatly damped and the exciter forces are so small that the resulting vibration movements are not directly disruptive. Over a more or less extensive period of time, however, these vibration movements are impressed into the plastic coatings of the elastic rolls.

The nearest integral multiples of the roll rotational frequency are usually impressed into the rolls as a pattern. This results in a regeneration of the vibration. The vibration amplitudes then increase exponentially. They are expressed on the one hand in an increased noise level (up to more than 120 dB(A)), and on the other in periodic fluctuations in thickness of the paper web running through. Varying periods of time are observed in practice in which these regeneration phenomena, which are expressed in barrings, develop. Some days or weeks usually pass until this phenomenon has grown so much that it disrupts the production process.

Not all of these natural frequencies are critical. Frequencies that are relatively low do not usually have a disruptive effect on the rolls. Although frequencies that are relatively high can under certain circumstances produce barrings on the paper web, these crosswise stripes are so close together that they are basically impossible to distinguish. The natural vibrations can be calculated with known numerical procedures, e.g., with procedures that work with finite elements. Programs for this are commercially available. A program with which the natural vibrations can be calculated is available under the name "Ansys."

If a roll is displaced relative to (e.g., substantially perpendicular to) the press plane at periodic intervals, i.e., with a certain regularity, this is an interference with the vibration system. If it is assumed that the elastic surface of a soft roll is deformed by these vibrations, then although the vibration is not eliminated by the roll displacement, the point of application of the vibration on the roll is changed.

Thus, it can be ensured that a barring pattern that has formed, is changed back again, whereby either the need for the roll to be reworked can be prevented or at least the time for reworking can be postponed and thus the service life of the roll prolonged.

The time intervals are preferably shorter than an impressing time in which visible barring patterns appear on the surface of the elastic roll. The impressing times are known from experience. They are, e.g., several days. If the time intervals are selected closer together and a roll displacement occurs, e.g., every day, i.e., approximately every 24 hours, one can be relatively sure that an impression of the barring pattern has not yet become visible on the surface of the soft roll. Therefore, this barring pattern can be eliminated or at least changed back before the produced paper web becomes broke.

Preferably a soft roll is displaced. Thus, the point at which a disruption is to be feared is tackled directly. Experience has shown that the impression of barring patterns on the soft roll can thus be best avoided.

A displacement distance is preferably selected at random. A random selection at least statistically ensures that the roll is not always displaced by the same distance. The risk of having the roll always work only at two identical positions by displacement and that particularly marked barring phenomena develop there in particular, is thus kept to a minimum.

It is particularly preferred here that a displacement distance is established and a deviation from this is determined at random. A particularly suitable displacement distance is thus selected and variations to this displacement distance are allowed only within certain ranges. Thus, it is ensured that one is really working within the optimal range or at least close to the optimum.

Preferably a displacement distance is selected in which a change in distance results on the surface of the roll in the range of about one-half to one-quarter of a wavelength which is associated with a critical natural frequency of the roll stack. The difference in distance thereby results between two nips, namely the distance between two nips on one half of the roll becomes larger by the corresponding distance, whereas it is reduced accordingly on the other side. This approach has several advantages. For one thing, the displacement is relatively small. As a rule, it is in the range of about 10 mm, and often smaller, so that no change worth mentioning results in the geometry of the roll stack due to the displacement. It can therefore still be assumed that the forces of pressure also act in the press plane. Moreover, this embodiment has the advantage that a barring formation does not occur at the critical natural frequency or at least is very much delayed. This is based on the following consideration: Over time, only those wavelengths on a roll circumference whose integral multiple is the same as the roll circumference can add up. All other wavelengths erase themselves with time. Accordingly, integral multiples of the roll rotational frequencies that are close to a natural frequency are possible frequencies that develop as barring. However, the number of developing wavelengths does not depend only on the proximity to the natural frequency, but also on the vibration shape. The vibration shape is decisive for whether an even integral multiple or an odd integral multiple of the roll rotational frequency develops. With an even multiple, the elastic roll is loaded from both sides as it were at each wave. With an odd multiple a load on one side is opposed by an unloading on the other side. If a difference in distance of one-quarter wavelength is made on the surface of the roll, a phase shift of the waves by $\lambda/2$ occurs. In this case the two nips in which the soft roll is involved are no longer directly coupled. A regenerative coupling of the individual nips to themselves can only be disrupted by a time change of the roll rotational speed.

The displacement distance is preferably selected in the range of about one-quarter to about one-eighth of the wavelength. The difference in distance on the surface of the roll by about one-quarter of a wavelength can be produced by adding (on one half of the roll) or removing (on the other half of the roll) one-eighth of a wavelength at each nip. The displacement can thus be kept relatively small overall.

The time intervals are preferably selected at random. Here too, the occurrence of stationary conditions due to the selection of fixed time intervals, which conditions can promote the formation of barring patterns is avoided.

It is particularly preferred here that a time interval is established and deviations from it determined at random. The time intervals between the individual displacement movements of the roll are therefore kept within a certain framework or in a certain range, and this range is only varied within certain limits, e.g., about ±20%.

The present invention is directed to a process for operating a calender with a roll stack having a plurality of rolls, including two end rolls arranged to form a press plane and middle rolls arranged between the end rolls, the plurality of rolls including at least one elastic roll. The process includes displacing at least one roll relative to the press plane at periodic intervals.

According to a feature of the instant invention, the at least one roll can be displaced substantially perpendicularly to the press plane.

In accordance with another feature of the invention, the at least one roll can be the at least one elastic roll. Further, the middle rolls can include the at least one elastic roll.

The period intervals are shorter than an impressing time in which visible barring patterns appear on a surface of the at least one elastic roll.

According to still another feature of the present invention, the at least one roll may include a soft roll.

The process can further include randomly selecting a displacement distance by which the at least one roll is displaced. The random selection of the displacement distance may include establishing a displacement distance and randomly deviating from the established displacement distance.

Moreover, operation of the roll stack has a critical natural frequency and the process may further include selecting a displacement distance in which a change in distance results on a surface of the at least one roll in a range of one-half to one-quarter of a wavelength of the critical natural frequency of the roll stack. The selected displacement distance can be in a range between one-quarter to one-eighth of the wavelength.

Further, the time intervals are randomly determined, and the random determination of the time interval may include establishing a time interval and randomly deviating from the established time interval.

According to a further feature of the invention, the at least one roll can be coupled to an end of a pair of levers and an other end of the pair of levers can be supported by eccentric bearings, and the displacing may include rotating the eccentric bearings to effect movement in a direction substantially perpendicular to the press plane.

In accordance with a still further feature of the present invention, the at least one roll can be coupled to an end of a pair of levers and an other end of the pair of levers can be supported in a slidable block, and the displacing may include sliding the slidable block in a direction substantially perpendicular to the press plane.

Still further, the at least one roll may be coupled to an end of a pair of adjustable length levers, and the displacing can include adjusting the length of adjustable length levers in a direction substantially perpendicular to the press plane.

According to still another feature of the instant invention, the at least one roll may be coupled to an end of a pair of levers via a pivotable bearing housing, and the displacing can include pivoting pivotable bearing housing to effect movement in a direction substantially perpendicular to the press plane.

The instant invention is directed to a calender apparatus that includes a roll stack composed of a plurality of rolls arranged to form at least one soft nip. The plurality of rolls include two end rolls arranged to form a press plane and middle rolls arranged between the two end rolls. The calender apparatus also includes a device for displacing at least one roll relative to the press plane at periodic intervals.

According to a feature of the invention, the displacing device may be structured and arranged to displace the at least one roll a distance of between about one-quarter wavelength and one-eight wavelength of a critical natural frequency of the roll stack.

Further, the displacing device can be structured and arranged to displace the at least one roll in a direction substantially perpendicularly to the press plane.

In accordance with another feature of the invention, the at least one roll is a soft roll. Still further, the soft roll can be one of the middle rolls.

In accordance with still another feature of the instant invention, a distance by which the displacing device displaces the at least one roll is randomly selectable. The randomly selectable displacement distance can be a random deviation from a predetermined displacement distance.

In accordance with another feature of the present invention, a time interval for displacing the at least one roll is randomly determined. The randomly determined time interval may be a random deviation from a predetermined time interval.

The calender apparatus can further include a pair of levers having two ends and supported at one end by eccentric bearings. The at least one roll may be coupled to an end of the pair of levers opposite the eccentric bearings, such that rotation of the eccentric bearings effects movement in a direction substantially perpendicular to the press plane.

Further, the calender apparatus can further include a pair of levers having two ends and supported at one end in a sliding block structured and arranged for sliding movement in a direction substantially perpendicular to the press plane. The at least one roll may be coupled to an end of the pair of levers opposite the sliding block.

According to still another feature of the invention, the calender apparatus can include a pair of levers having an adjustable length and two ends. The pair of levers can be structured and arranged to be length adjustable in a direction substantially perpendicular to the press plane to an end of a pair of adjustable length levers, and the at least one roll may be coupled to one of the two ends of the pair of levers.

In accordance with yet another feature of the present invention, the calender apparatus can further include bearing housings coupled to ends of the at least one roll and a pair of levers pivotably coupled to the bearing housings. Pivoting of the bearing housings effect movement substantially perpendicular to the press plane.

Further, the instant application expressly incorporates by reference in their entireties the disclosures of commonly owned U.S. application Ser. Nos. 10/192,529, 10/192,499 and 10/192,530, based upon German Patent Application Nos. 101 33 890.2, 101 33 888.0, and 101 33 891.0 filed Jul. 12, 2001, respectively, as well as the disclosures of the above-noted German Applications.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
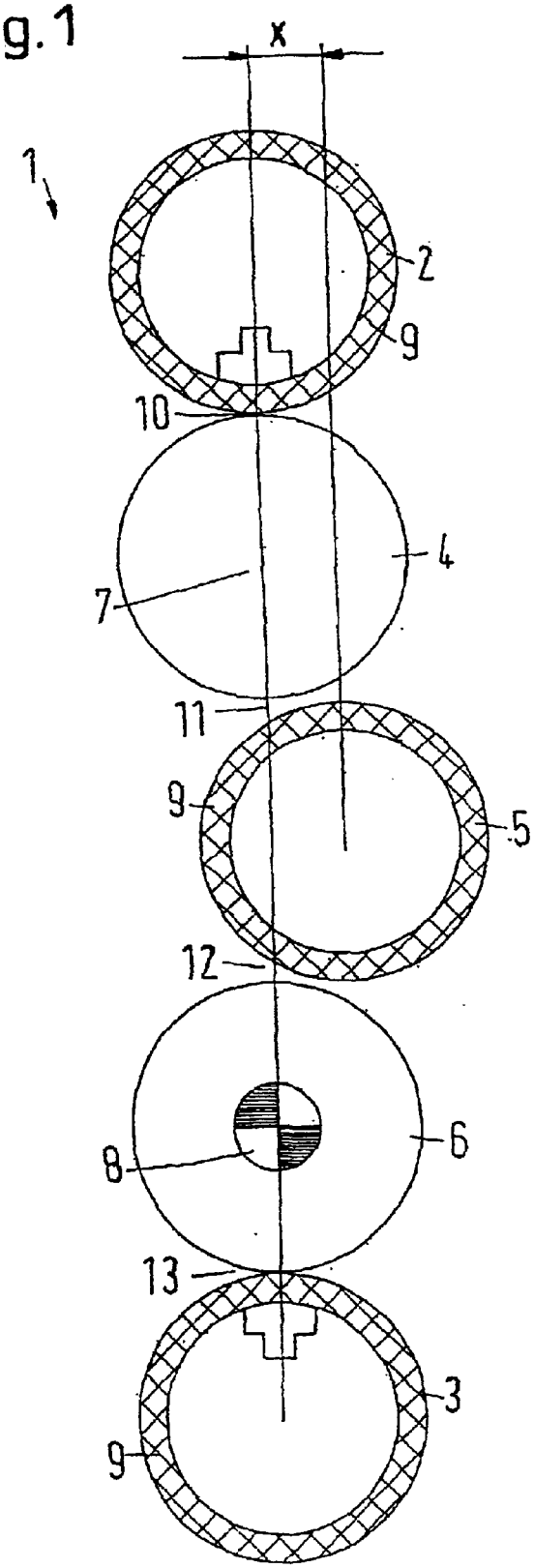
FIG. 1 schematically illustrates a calender.

FIG. 1 shows a diagrammatic representation of a calender 1 with two end rolls 2 and 3 which are embodied as load-deflection rolls, and three middle rolls 4, 5, and 6, which together form a roll stack. The roll stack features a roll plane 7, in which the axes of all rolls 2–6 lie when rolls 2–6 are arranged exactly above one another. The press direction, i.e., the direction in which rolls 2–6 are pressed against one another, also lies in roll plane 7 for the purposes of the following description.

Further details of the calender are represented only in diagrammatic form, such as a drive 8, or omitted completely, such as devices for heating individual rolls. However, end rolls 2 and 3 and middle roll 5 feature an elastic coating 9, which is shown with exaggerated thickness.

During the operation of the calender, rolls 2–6 form nips 10–13 in a known manner, and the material web to be treated is guided through nips 10–13. All nips 10–13 are embodied or formed as so-called soft nips, since they are limited by one hard and one soft roll.

Middle roll 5 can now be displaced relative to, e.g., substantially perpendicular to, roll plane 7 by a distance X at periodic intervals. Accordingly, distance X forms a displacement of roll 5. This displacement can be adjusted in different ways. The necessary considerations for this will be explained on the basis of FIG. 3.

Figure 3:
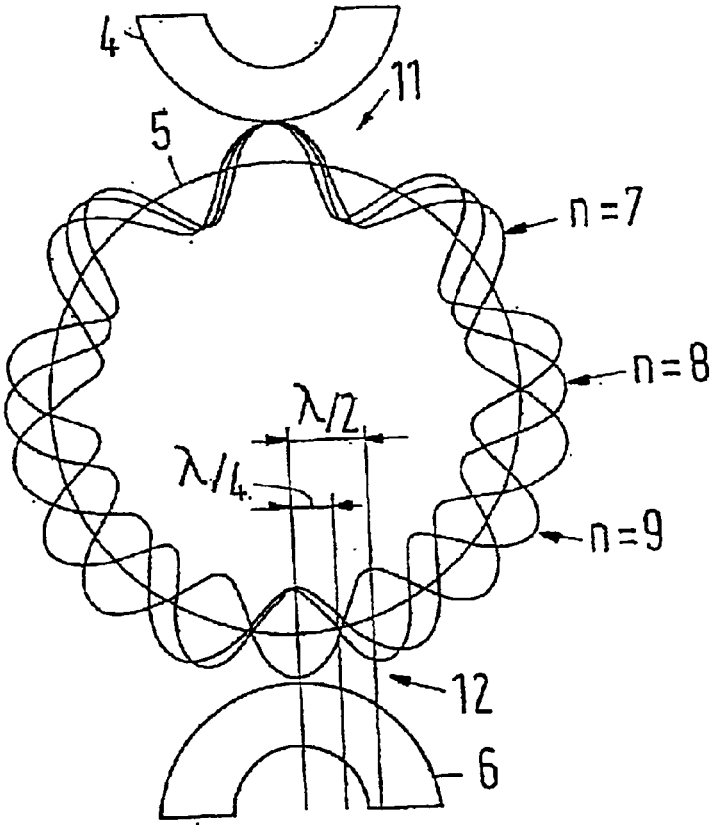
FIG. 3 diagrammatically explains the formation of a barring pattern.

FIG. 3 shows roll 5, roll 4 located above it, and roll 6 located below it. Various reference waveforms are represented with exaggerated amplitudes, namely a waveform in which seven waves run around the circumference of roll 5, a waveform with eight waves and a waveform with nine waves. The numbers n=7, 8, 9 were chosen for reasons of clarity and ease of explanation. In the case of real rolls, a correspondingly higher number of waves develop over the circumference of the rolls, e.g., in the range of 30 to 50. In the case of such a high number of waves running around the circumference of roll 5, it can be assumed in a first approximation that a curvature of roll 5 does not matter when a small displacement movement of roll 5 relative to roll plane 7 occurs, which is less than one wavelength.

If roll 5 is now displaced by displacement X, it is ensured that the distance between two nips 11 and 12 is increased by 2X on one side of roll plane 7 and reduced by 2X on the other side. Displacement X can either be completely random, for which a randomizer (not shown in detail) can provided, or, in many cases, it may be more favorable if displacement X is selected in a range of between one-quarter of a wavelength (i.e., $x=\lambda/4$) and one-eighth of a wavelength (i.e., $x=\lambda/8$). A randomizer can then be utilized to provide only small deviations from these set values, e.g., deviations in a range of about ±30%. In this way a possibility of roll 5 always inevitably coming to the same positions is avoided, as is the possibility of certain barring patterns being impressed at these same positions.

Through the roll displacement, which causes a lengthening of the distance between nips 11 and 12 of a quarter wavelength $\lambda/4$, it can be assumed that the disturbances will develop separately from each other with half the intensity, given the same excitation by the coupling with the two neighboring rolls, so that in theory a doubling of the service life can be achieved. If roll 5 is again displaced before a visible impression of a new barring pattern occurs, e.g., in a direction toward press plane 7, a change back of surface 9 of soft roll 5 results.

The approach for calculating a set value for the displacement will now be explained on the basis of an example. The calender should feature a normal speed of 1280 m/min, i.e., all rolls should rotate at a circumferential speed of 1,280 m/min. It is hereby assumed that roll 4 has a diameter of 870 mm, roll 5 a diameter of 874 mm and roll 6 a diameter of 878 mm. Accordingly, the circumference of such rolls are calculated as 2733.1855 mm, 2745.7520 mm and 2758.3184 mm, respectively.

It can be independently (or previously) determined with a finite elements process that a natural system frequency fe of 277.3120 Hz exists, whereby the natural system frequency shape lies asymmetrically to roll 5.

A roll rotational frequency fw of 7.8053 Hz, 7.7696 Hz or 7.7342 Hz can calculated for rolls 4, 5 and 6, respectively, from the above-mentioned roll circumferences and a planned production speed, i.e., the normal speed. Thus, a theoretical barring number of 35.5287, 35.6920 and 35.8554 results for rolls 4, 5, and 6, respectively from a quotient of fe/fw. The closest whole odd number, i.e., 35, is taken as a closest barring number. Without displacement, it can be assumed that a barring pattern would develop on roll 5 with a wavelength that corresponds to the circumference of roll 5 (i.e., 2745.752 mm) divided by 35, i.e., a wavelength of 78.4501 mm.

If roll 5 is again displaced again by roll displacement X of one-eighth of a wavelength (i.e., 78.4501 mm/8=9.8063) with a random deviation of ±20%, it can be assumed with a very high degree of probability that a barring formation with this wavelength will not appear or will appear only very late. The service life of elastic roll 5 is thereby drastically increased by displacement X. Moreover, the displacement of roll 5 within a range of approximately 10 mm is so small that the geometrical ratios in the roll stack are not greatly reduced.

Roll displacement X does not have to be made very frequently. As empirical values show that a barring pattern forms after approximately 5 days of operation, it is sufficient if roll 5 is displaced by displacement X approximately every 24 hours or even approximately every 48 hours. The selection of time intervals can also be made at random, e.g., a fixed value, such as 24 hours can be established from which a randomizer produces deviations, so that roll 5 is displaced in at time intervals within a range of about 22 to 26 hours. This, too, serves to prevent a certain pattern being impressed on the surface of the roll.

The periodic roll displacement is particularly advantageous in calenders featuring several natural system frequencies. Because the roll displacement is not set in a fixed manner for a long period, but instead is changed from time to time, it is possible to eliminate the manifestations of virtually all natural system frequencies.

FIGS. 2*a*–2*d* now disclose various possibilities for effecting the roll displacement. In each case, the explanation is made with the example of middle roll 5, which is supported in a bearing housing 30 located at a front end of a lever 31.

Figure 2A:
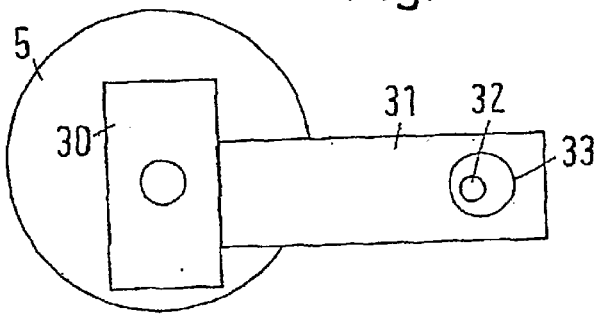
FIGS. 2*a*–2*d* schematically illustrate various embodiments for displacing a roll.

In the exemplary embodiment according to FIG. 2*a*, lever 31 is supported with a bearing point 32 in an eccentric bushing 33. When eccentric bushing 33 is twisted, the position of roll 5 is changed in the horizontal direction.

Figure 2B:
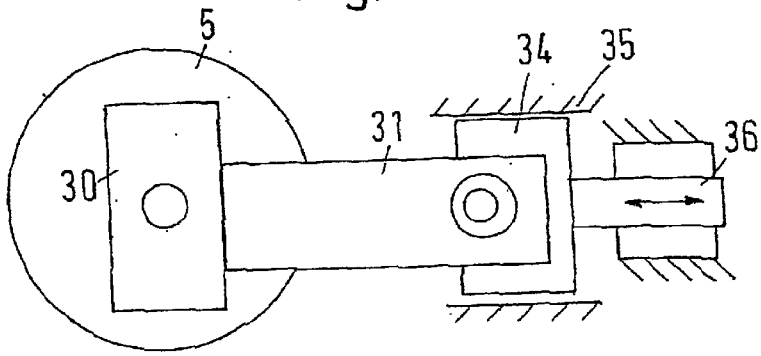

In an exemplary embodiment according to FIG. 2*b*, lever 31 is supported in a sliding block 34, which can be moved in housing 35 by a linear drive 36 (shown only diagrammatically). Linear drive 36 can be implemented or formed, e.g., as a threaded spindle. Relatively precise shifting movements are also possible with the threaded spindle.

Figure 2C:
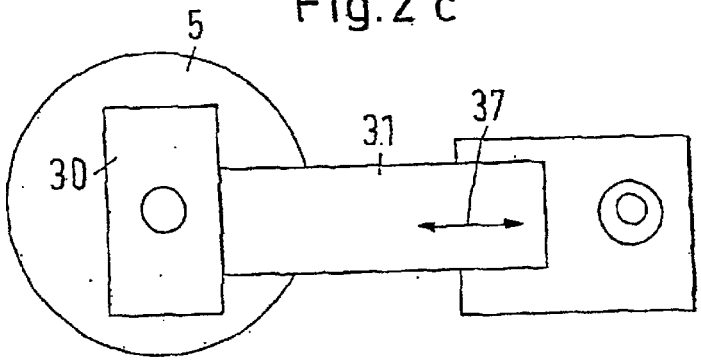

In the exemplary embodiment according to FIG. 2*c*, lever 31 is embodied or formed as adjustable in length, which is represented by double arrow 37. Lever 31 can feature, e.g., a telescopic or a prismatic guide. The two parts of lever 31 that can be shifted in opposition, can also be driven via a threaded spindle (not shown in detail).

Figure 2D:
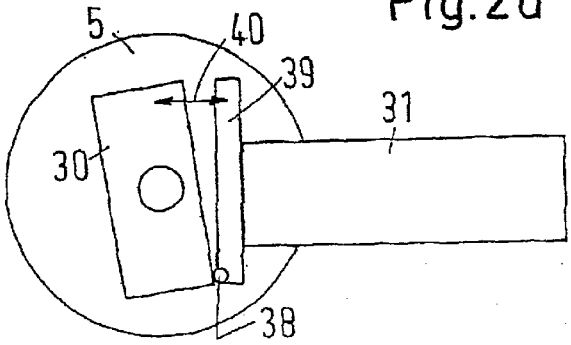

In the exemplary embodiment according to FIG. 2*d*, bearing housing 30 is connected to lever 31 via a swivel joint 38. Swivel joint 38 is arranged at the lower end of a fastening plate 39 which, in turn, is attached to lever 31. Of course, an attachment at the upper end is also possible. A diagrammatically represented tilting gearing 40 is provided in order to tilt bearing housing 30 relative to lever 31 by a defined amount.

The adjusting path is hereby laid out so that it leads to a displacement X relative to press plane 7, i.e., out of or into press plane 7, which is sufficient to disturb or to eliminate the development of a barring pattern on the surface of the elastic roll. To remove a barring pattern it can be useful to select displacement X of about one-quarter wavelength (i.e., $\lambda/4$)±20%, which causes a difference in distance of about $\lambda/2$ on the surface of roll 5, whereby $\lambda$ is the wavelength of the newly occurring barring pattern. However, in many cases a regular displacement X of about one-eighth wavelength (i.e., $\lambda/8$)±20% is sufficient to prevent the development of a barring pattern becoming visible. The displacement is usefully made alternately outward and inward. It can be made automatically, whereby the displacement constructions shown in FIG. 2 are driven by a motor.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for operating a calender with a roll stack having a plurality of rolls, including two end rolls arranged to form a press plane and middle rolls arranged between the end rolls, the middle rolls including at least one elastic roll, the process comprising:

displacing at least one of the elastic middle rolls relative to the press plane at periodic intervals.

2. The process in accordance with claim 1, wherein the at least one roll is displaced substantially perpendicularly to the press plane.

3. The process in accordance with claim 1, wherein the period intervals are shorter than an impressing time in which visible barring patterns appear on a surface of the at least one elastic roll.

4. The process in accordance with claim 1, wherein the at least one roll comprises a soft roll.

5. The process in accordance with claim 1, further comprising randomly selecting a displacement distance by which the at least one roll is displaced.

6. The process in accordance with claim 5, wherein the random selection of the displacement distance comprises establishing a displacement distance and randomly deviating from the established displacement distance.

7. The process in accordance with claim 1, wherein operation of the roll stack has a critical natural frequency and the process further includes selecting a displacement distance in which a change in distance results on a surface of the at least one roll in a range of one-half to one-quarter of a wavelength of the critical natural frequency of the roll stack.

8. The process in accordance with claim 7, wherein the selected displacement distance is in a range between one-quarter to one-eighth of the wavelength.

9. The process in accordance with claim 1, wherein the time intervals are randomly determined.

10. The process in accordance with claim 9, wherein the random determination of the time interval comprises establishing a time interval and randomly deviating from the established time interval.

11. The process in accordance with claim 1, wherein the at least one roll is coupled to an end of a pair of levers and an other end of the pair of levers is supported by eccentric bearings, and the displacing comprises rotating the eccentric bearings to effect movement in a direction substantially perpendicular to the press plane.

12. The process in accordance with claim 1, wherein the at least one roll is coupled to an end of a pair of levers and an other end of the pair of levers is supported in a slidable block, and the displacing comprises sliding the slidable block in a direction substantially perpendicular to the press plane.

13. The process in accordance with claim 1, wherein the at least one roll is coupled to an end of a pair of adjustable length levers, and the displacing comprises adjusting the length of adjustable length levers in a direction substantially perpendicular to the press plane.

14. The process in accordance with claim 1, wherein the at least one roll is coupled to an end of a pair of levers via a pivotable bearing housing, and the displacing comprises pivoting pivotable bearing housing to effect movement in a direction substantially perpendicular to the press plane.

15. A calender apparatus comprising:

a roll stack composed of a plurality of rolls arranged to form at least one soft nip;

said plurality of rolls including two end rolls arranged to form a press plane and middle rolls, comprising at least one roll, arranged between said two end rolls; and a device for displacing at least one of said elastic middle rolls relative to the press plane at periodic intervals.

16. The calender apparatus in accordance with claim 15, wherein said displacing device is structured and arranged to displace said at least one roll a distance of between about one-quarter wavelength and one-eight wavelength of a critical natural frequency of the roll stack.

17. The calender apparatus in accordance with claim 15, wherein said displacing device is structured and arranged to displace said at least one roll in a direction substantially perpendicularly to the press plane.

18. The calender apparatus in accordance with claim 15, wherein the period intervals are shorter than an impressing time in which visible barring patterns appear on a surface of the at least one elastic roll.

19. The calender apparatus in accordance with claim 15, wherein a distance by which the displacing device displaces said at least one roll is randomly selectable.

20. The calender apparatus in accordance with claim 19, wherein the randomly selectable displacement distance is a random deviation from a predetermined displacement distance.

21. The calender apparatus in accordance with claim 15, wherein a time interval for displacing the at least one roll is randomly determined.

22. The calender apparatus in accordance with claim 21, wherein the randomly determined time interval is a random deviation from a predetermined time interval.

23. The calender apparatus in accordance with claim 15, further comprising a pair of levers having two ends and supported at one end by eccentric bearings, wherein the at least one roll is coupled to an end of said pair of levers opposite said eccentric bearings, such that rotation of the eccentric bearings effects movement in a direction substantially perpendicular to the press plane.

24. The calender apparatus in accordance with claim 15, further comprising a pair of levers having two ends and supported at one end in a sliding block structured and arranged for sliding movement in a direction substantially perpendicular to the press plane, wherein the at least one roll is coupled to an end of said pair of levers opposite said sliding block.

25. The calender apparatus in accordance with claim 15, further comprising:

a pair of levers having an adjustable length and two ends;

said pair of levers being structured and arranged to be length adjustable in a direction substantially perpendicular to the press plane to an end of a pair of adjustable length levers; and said at least one roll being coupled to one of said two ends of said pair of levers.

26. The calender apparatus in accordance with claim 15, further comprising:

bearing housings coupled to ends of said at least one roll; and a pair of levers pivotably coupled to said bearing housings;

wherein pivoting of said bearing housings effect movement substantially perpendicular to the press plane.

27. A process for operating a calender with a roll stack having a plurality of rolls, including two end rolls arranged to form a press plane and middle rolls arranged between the end rolls, the middle rolls including at least one elastic roll, the process comprising:

displacing at least one of the elastic middle rolls relative to the press plane at random intervals.

28. A calender apparatus comprising:

a roll stack composed of a plurality of rolls arranged to form at least one soft nip;

said plurality of rolls including two end rolls arranged to form a press plane and middle rolls, comprising at least one elastic roll, arranged between said two end rolls; and a device for displacing at least one of said elastic middle rolls relative to the press plane at random intervals.

* * * * *